US005901889A

United States Patent [19]

Ho

[11] Patent Number: 5,901,889

[45] Date of Patent: May 11, 1999

[54] AUXILIARY POSITIONING DEVICE OF THE WATER OUTLET TUBE OF A WATER BAG

[76] Inventor: Kuo-Ping Ho, Fl. 11, No. 294, Sec. 2, Tung-Hwa St., Taipei, Taiwan

[21] Appl. No.: 08/992,454

[22] Filed: Dec. 17, 1997

[51] Int. Cl.[6] ..... A45F 5/00; A45F 3/04

[52] U.S. Cl. ..... 224/148.2; 224/647; 126/DIG. 26

[58] Field of Search ..... 224/148.1, 148.2, 224/250, 251, 269, 647, 182; 222/175; 128/205.22, DIG. 26; 138/DIG. 8

[56] References Cited

U.S. PATENT DOCUMENTS

| | | | |
|---|---|---|---|
| 2,704,556 | 3/1955 | Blish | 138/DIG. 8 |
| 4,435,174 | 3/1984 | Redmond et al. | 128/DIG. 26 |
| 5,282,557 | 2/1994 | McCook | 224/148.2 |
| 5,400,934 | 3/1995 | Ducros | 224/148.2 |
| 5,427,290 | 6/1995 | Thatcher | 224/148.2 |
| 5,586,703 | 12/1996 | Radar et al. | 224/148.2 |
| 5,672,159 | 9/1997 | Warrick | 128/DIG. 26 |

*Primary Examiner*—Allan N. Shoap
*Assistant Examiner*—Gregory M. Vidovich
*Attorney, Agent, or Firm*—Dougherty & Troxell

[57] ABSTRACT

An auxiliary positioning device adapted for use with a water bag having a water outlet tube with a drinking end wherein the water bag is securable to a user. The device comprising a fixing seat, first and second hooks respectively coupled to opposing ends of the seat, a tube holder installed on the seat, a flexible extending rod secured to the seat, a bendable metal line secured with the extending rod, a plurality of spaced, additional tube holders secured to the extending rod, two through rings wherein each of the rings includes two holes therein wherein one of the holes includes an inclined guiding slot extending through a peripheral portion of the one hole to allow penetration by a strap, wherein, in use, the one hole of each ring is adapted to be coupled to a strap worn by a user by passing the strap through the guiding slot and in the one hole of each ring, the first and second hooks are respectively secured to the other of the holes of the through rings, the water outlet tube is penetrated through the tube holder on the seat and is further penetrated through each of the additional tube holders secured to the extending rod, and the extending rod with the metal line secured therewith is bent to position the drinking end of the water outlet tube relative to the user.

4 Claims, 11 Drawing Sheets

AUXILIARY POSITIONING DEVICE OF THE WATER OUTLET TUBE OF A WATER BAG

BACKGROUND OF THE INVENTION

1. Field of the Invention

The present invention relates to an auxiliary positioning device of the water outlet tube of a water bag, especially to a design on said water bag for positioning the water outlet tube thereof to a predetermined elevational angle so that as a user drinks water as well as exercises, he (or she) may position its water outlet tube by using the present invention, thus he (or she) may drink easily and conveniently without using hands, therefore the present invention has the effect of improving the practical usage of the water bag.

2. Description of the Prior Art

FIG. 1 shows a conventional, prior art water bag 1 which is designed as a water pocket. A water inlet tube 2 is extended downwards from the distal end thereof, which is shrewdly engaged by a cover 3, while a prolonged water outlet tube 4 is extended from the upper end of the bag and the distal end of this tube 4 is installed with a suction nozzle 5 having a check valve. A user bites the suction nozzle 5 so that the sealing steel ball 5A will compress a spring 5B thus allowing the water in the bag to pass through the suction nozzle and to be drunk by the user.

As shown in FIG. 2, the prior art water bag 1 may be used while exercising outdoors, such as while the user is riding a bicycle. In order for the user to obtain a drink of water from the water bag, the user must hold the outlet tube 4 by hand. Since the user is holding the outlet tube 4 with one hand, in the event of danger, the user may not quickly have both hands readily available unless the user can quickly stop holding the outlet tube 4.

Accordingly, in order to overcome the aforementioned inconvenience, an auxiliary positioning device of the water outlet tube of a water bag is generally used in the market, as shown in FIG. 3. For the positioning of the tube with the device shown in FIG. 3, two through rings A and B are installed on the upper and lower end thereof, while a canvas through belt C penetrates through said through rings repeatedly and then is tied so as to form a hard plate. A bendable multi-sectional guiding tube D is connected to an upper portion of the through belt C. In order to use the positioning device shown in FIG. 3, the outlet tube 4 of the water bag 1 is first cut to form a two section structure. An end tube near the water bag is inserted on the water inlet end E of the bendable guiding tube D and another tube end (not shown) installed with the suction nozzle 5 is inserted in the water outlet end F. Hence, the multi-sectional guiding tube allows a user to position the section nozzle by bending the multi-sectional guiding tube.

However, as the aforementioned prior art shown in FIG. 3, the following defects still exists:

(1) In the prior auxiliary positioning device of the water outlet tube of a water bag as shown in FIG. 3, the multi-sectional guiding tube D is not a water outlet tube with a suction nozzle on the distal end, thus in the whole, in using the water outlet tube of the original water bag, the tube must be cut to form a two sectional structure. Since the water outlet tube is adhered on the water bag, if it is destroyed, then the auxiliary positioning device of the water outlet tube of a water bag must be used permanently, thus people can not select the desired usage of the water bag 1 and water outlet tube 4.

(2) For a water bag filled with fruit juice or other non-mineral water, in order to clean the multi-sectional tube after being used, it has the problem that some dirt is hidden thereon, thus this is a harmful effect for the drinker.

SUMMARY OF INVENTION

Accordingly, since said aforementioned defects exist in the prior auxiliary positioning device of the water outlet tube of a water bag, a primary object of the present invention is to provide a more practical positioning device for an outlet tube of a water bag wherein the structure thereof is easily designed so that in using, the original water outlet tube will not be destroyed, and it may be positioned and installed easily. The whole practical effect is greatly increased.

Another object of the present invention is that auxiliary positioning device is purely employed for positioning not as the conducting path of water so that when the water bag is filled with fruit juice or other beverage, it still has no dirt adhering on the tube.

An auxiliary positioning device of the water outlet tube of a water bag used by an outdoor bicyclist for fixing the water outlet tube within a specific curved angle is formed by a fixing seat combined with two through rings, wherein the two through rings have a substantially rectangular shape with two holes, and one ring hole of each ring includes an inclined guiding slot for penetrating by a belt, wherein the fixing seat installed with hooks on opposite ends thereof for easily buckling with the other holes of the through rings so as to combine together, a tube holder which is formed integral being installed on the seat and a curved portion is integrally manufactured aside the tube holder, while a metal line with proper radius is installed on the curved portion and a plurality of positions on the curved portion are installed with tube holders; wherein, in use, the water outlet tube of a water bag is extended along a belt which supports the water bag on the bicyclist, penetrated through the tube holder on the fixing seat for fixing and then it is further penetrated through each of the tube holders of the curved portion. Thus, the water outlet tube of the bag may be positioned at a predetermined angle with respect to the bicyclist by the bicyclist bending the curved portion to the predetermined angle.

The present invention will be better understood and its numerous objects and advantages will become apparent to those skilled in the art by referencing to the following drawings.

DETAILED DESCRIPTION OF THE PREFERRED EMBODIMENT

Figure 1:
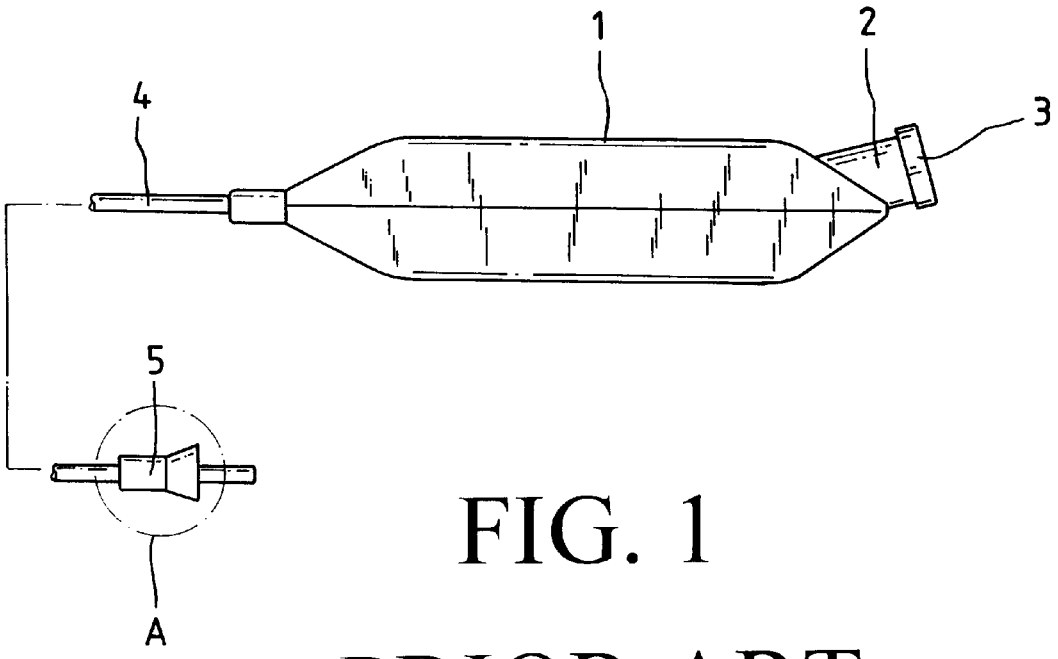
FIG. 1 PRIOR ART
FIG. 1 is a schematic view of the structure of the water bag in the prior art.
Figure 1A:
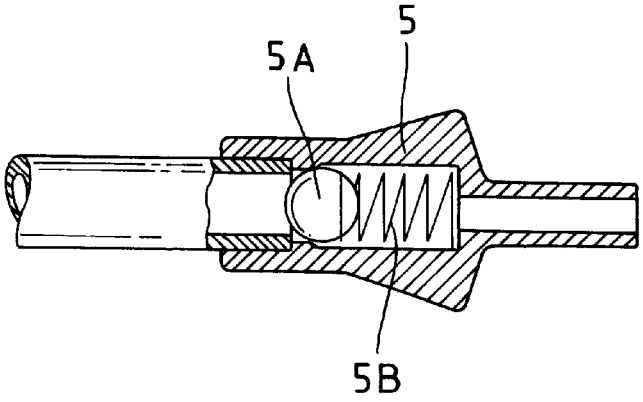
FIG. 1A PRIOR ART
FIG. 1A is an enlarged cross sectional view of the suction nozzle shown in FIG. 1.
Figure 2:
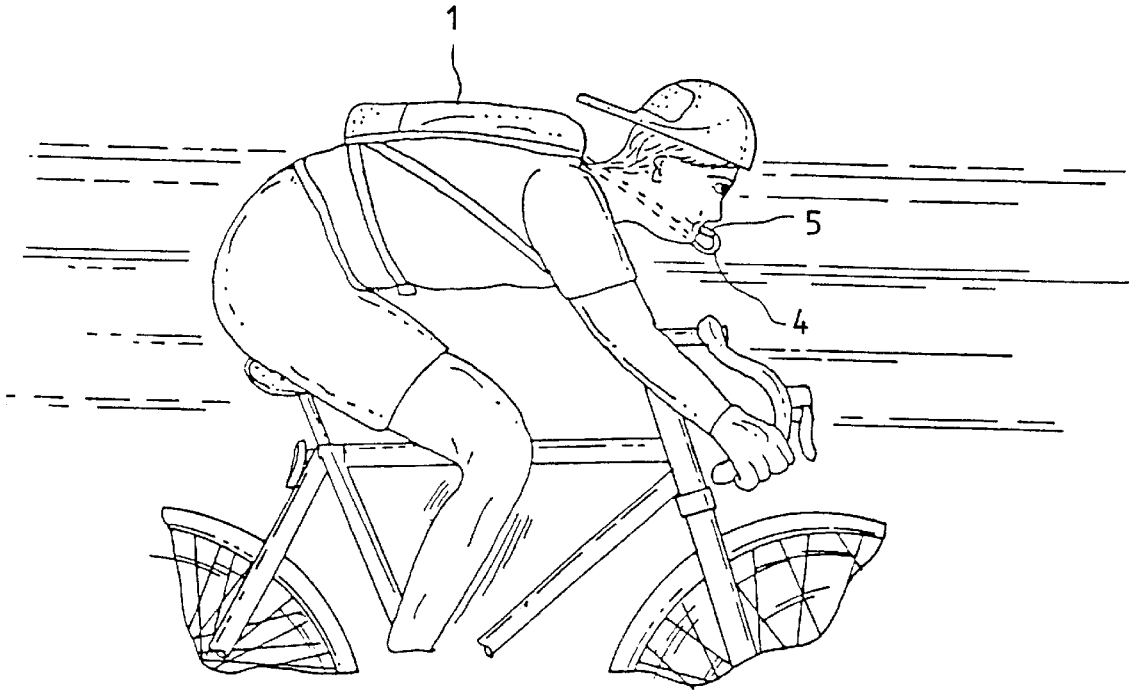
FIG. 2 is a schematic view shown the prior art invention in a moving condition.
Figure 3:
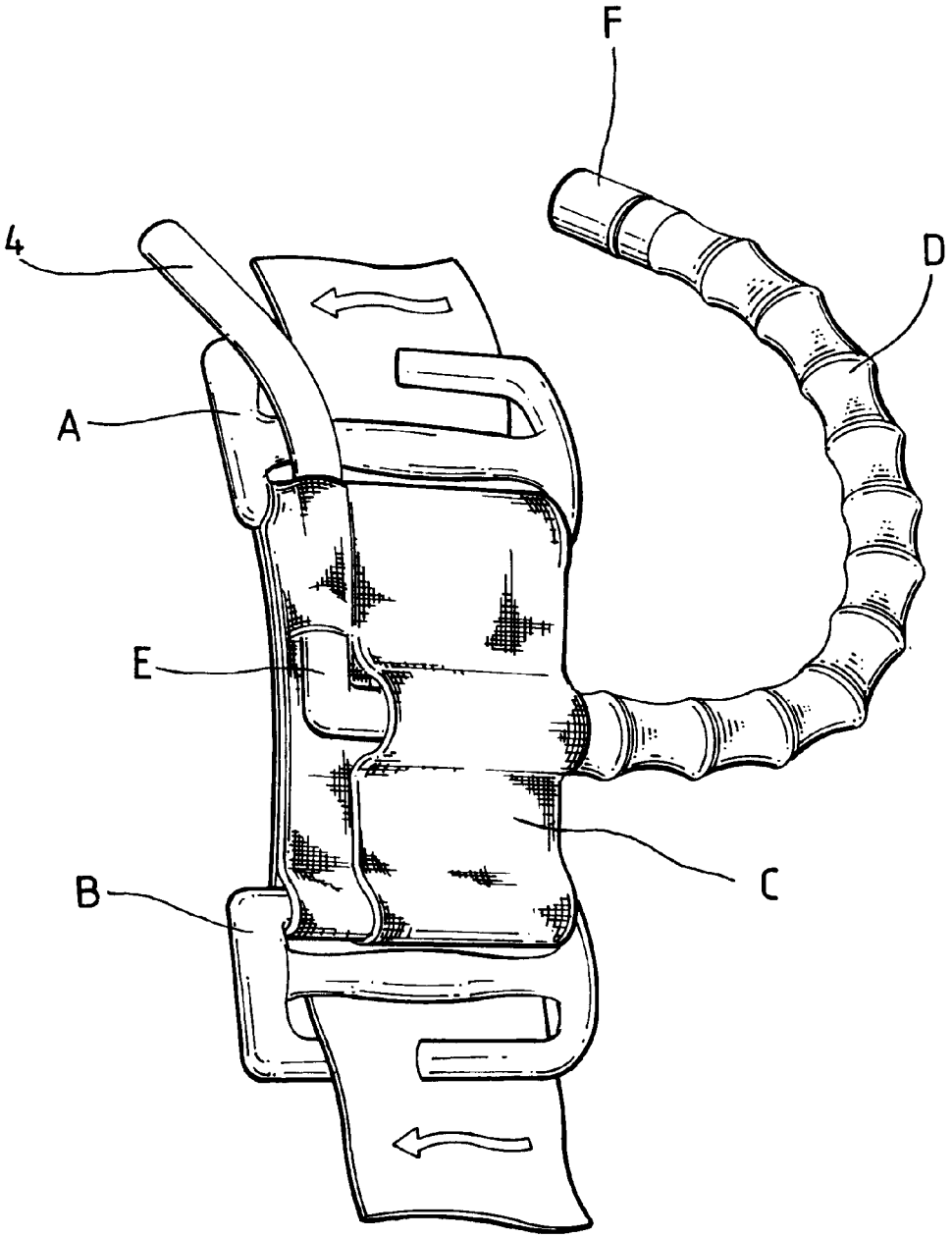
FIG. 3 PRIOR ART
FIG. 3 is an appearance of the auxiliary positioning device of the water outlet tube of a water bag in the prior art.
Figure 4:
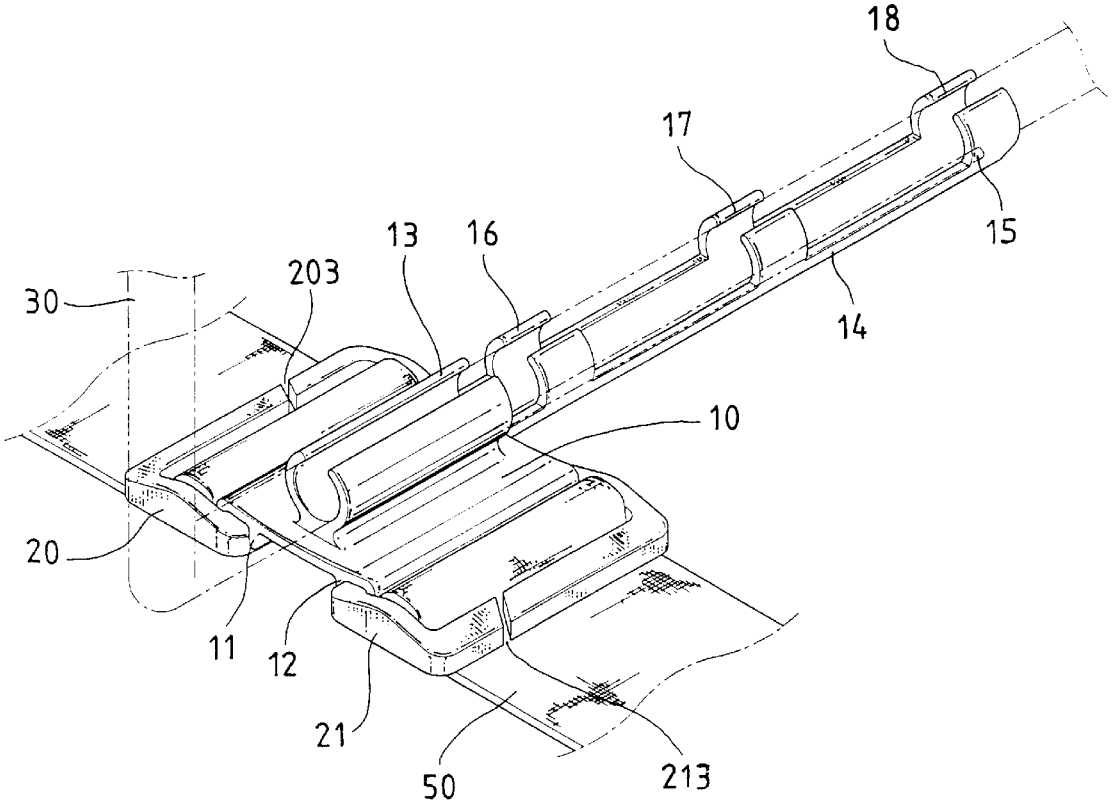
FIG. 4 is an appearance of the present invention.
Figure 5:
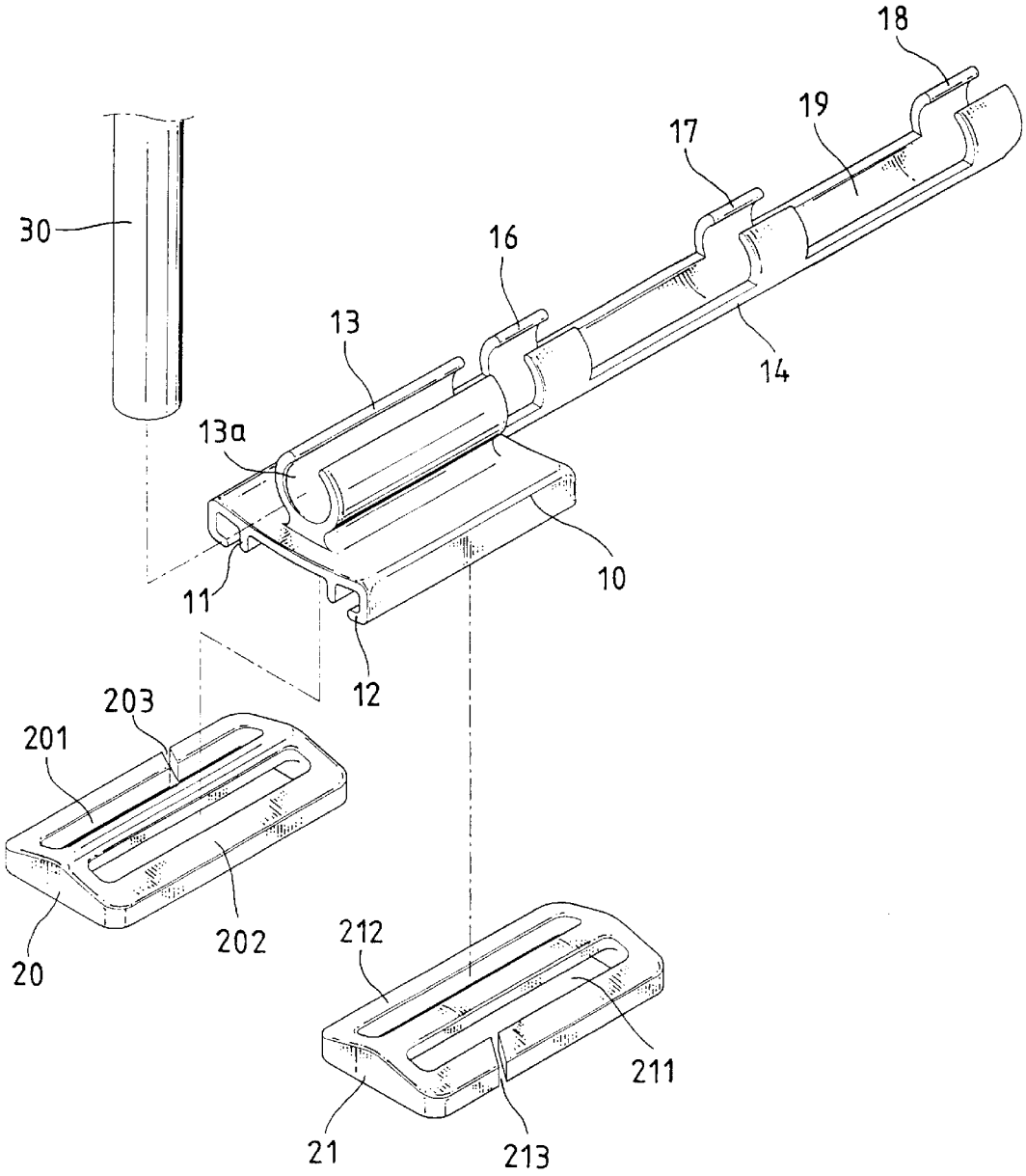
FIG. 5 is an exploded view of the present invention.
Figure 8:
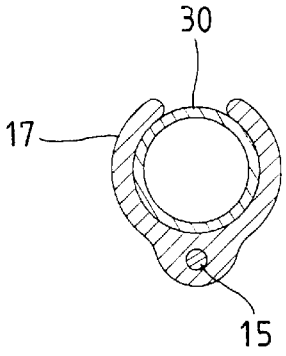
FIG. 8 is a cross sectional view along the line 8—8 of the present invention.

As shown in FIGS. 4 and 5, the structure of the auxiliary positioning device for bicycle water bag outlet tube of the present invention is shown. Basically, a fixing seat 10 is designed, the upper and lower ends thereof are designed with downward hooks 11 and 12, respectively and the upper surface thereof is installed with a fixing tube holder 13 for clamping the water bag outlet tube 30. An extending rod 14 made of soft plastic is installed on the side direction in which the fixing seat 10 is vertical to two penetrating rings 20 and 21 and is integrally formed as the seat is manufactured, and a metal line 15 with a proper radius is formed within the extending rod 14 (as shown in FIG. 8), while a plurality of fixing tube holders 16, 17, and 18 are installed on the upper surface of the extending rod 14 of the curved portion so that the slot 19 serially connected by said fixing tube holders may be just opposite to the inner hole 13*a* of the fixing tube holder 13 on the seat.

The two through rings 20 and 21 are a two hole ring having a θ shape and are installed with through holes 201 and 211 and ring frames 202 and 212, respectively, meanwhile inclined guiding slots 203 and 213 which are easy to be guided into by belts are provided with the through holes 201 and 211.

Figure 7:
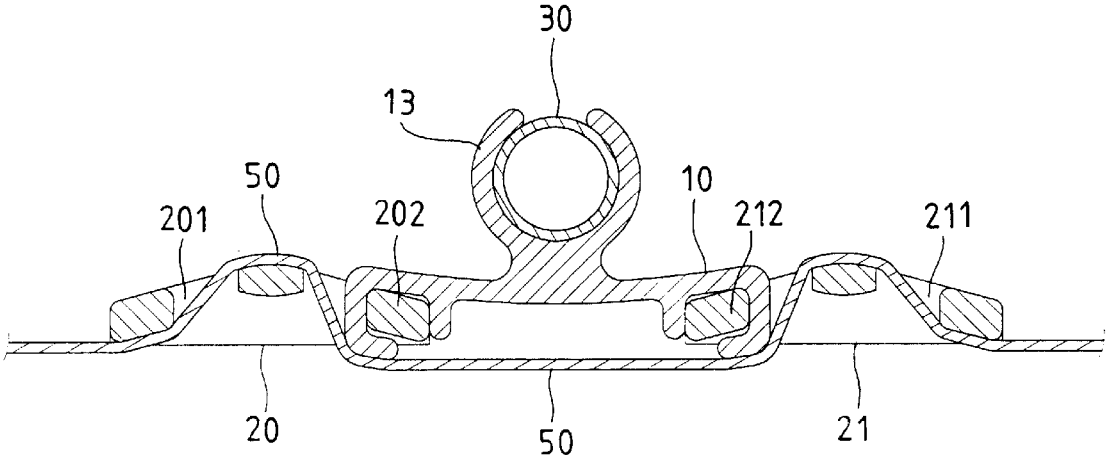
FIG. 7 is a cross sectional view along the line 7—7 of the present invention.

Now referring to FIG. 7, in assembling, the two hooks 11 and 12 on the upper and lower ends of the fixing seat 10 are buckled and engaged with the ring frames 202 and 212 of the through rings. However, it is expected that after the hook and the ring frame are combined together, there is a small gap 40 for rotation and displacement, this characteristic is sufficient to provide the user a preferred effect for the belt 50 to adhere on the breast.

Figure 6:
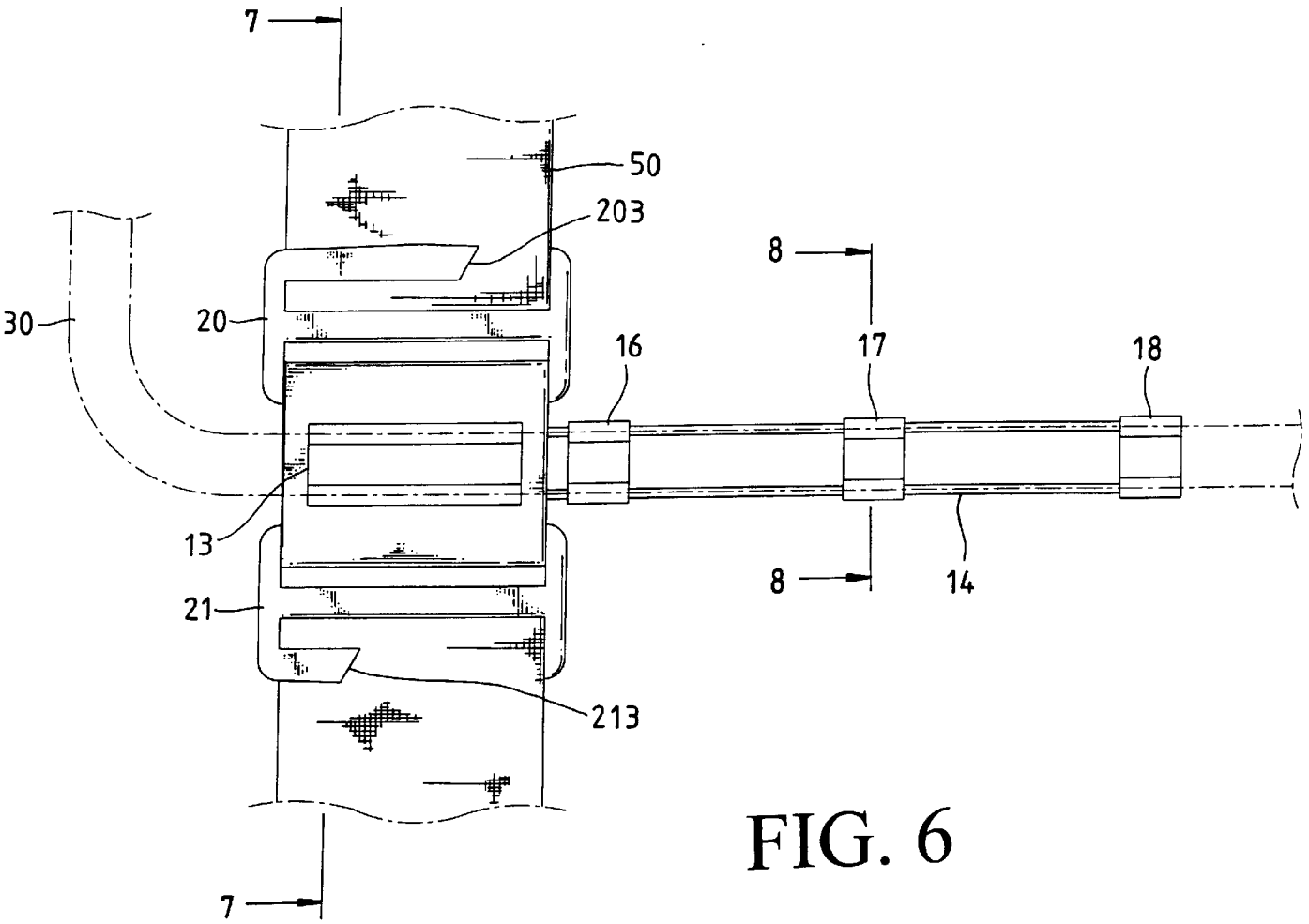
FIG. 6 is a top view of the present invention.
Figure 9:
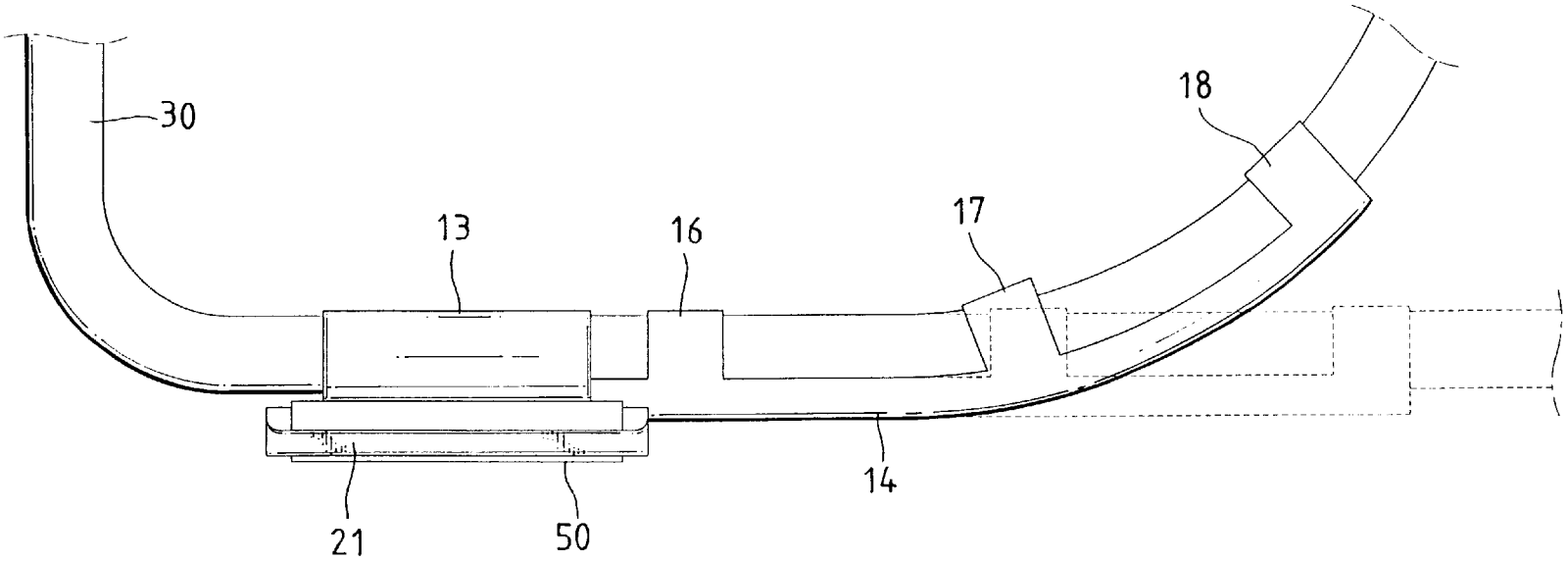
FIG. 9 is a schematic view showing the positioning of the curved portion.
Figure 12:
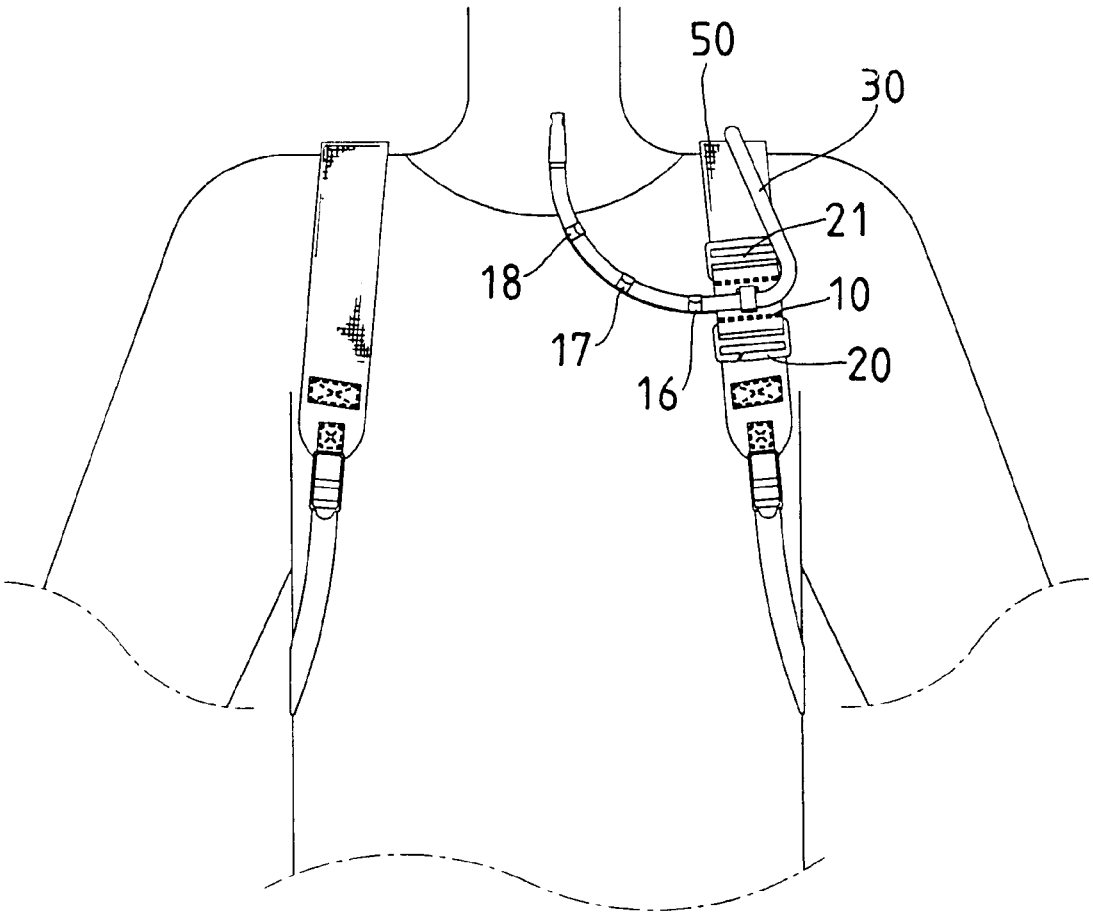
FIG. 12 is a typical example of the present invention in FIG. 10 in which the device is combined with a water outlet tube.

Now referring to FIGS. 6, 9, and 12, during use of present invention, the through ring belt 50 of the water bag is combined through the guiding slots 203 and 213 of the through ring 20 and 21 so that the auxiliary positioning device may be adjusted freely to a proper height. Then outlet tube 30 of the water bag 10 is firstly penetrated through the inner hole 13*a* of the fixing tube holder 13 on the seat and then penetrated through or buckled on the fixing tube holders 16, 17 and 18. Next a force is applied on the extending rod 14 for bending said rod, then the metal line 15 buried into the extending rod 14 will be deformed by said applied force, thus the curved angle between the distal suction nozzle of the water outlet tube 30 and the mouth of the user is set, therefore, the extending rod 14 is positioned at a predetermined angle by the metal line therewithin.

Figure 10:
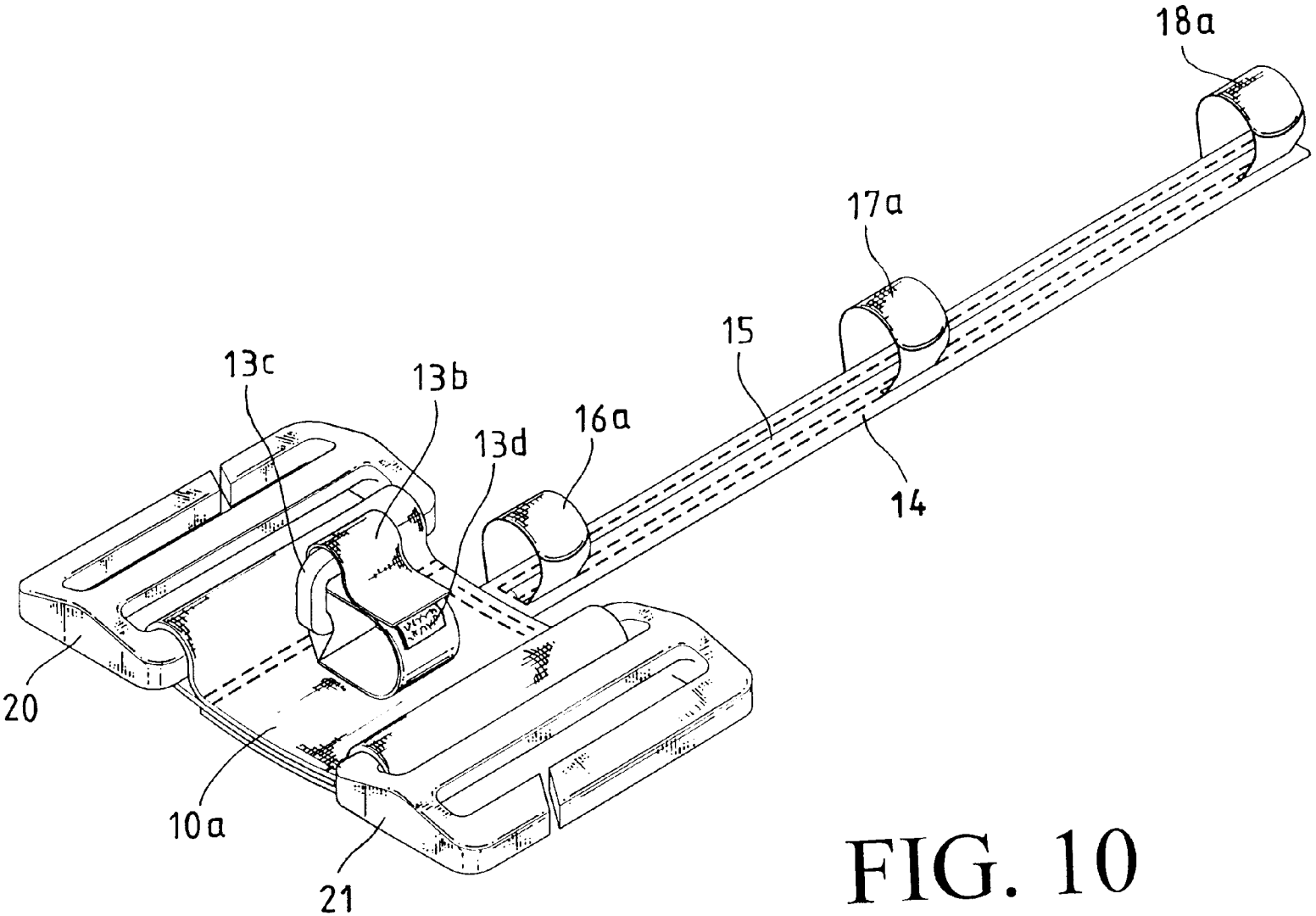
FIG. 10 is a perspective view of another embodiment of the present invention.
Figure 11:
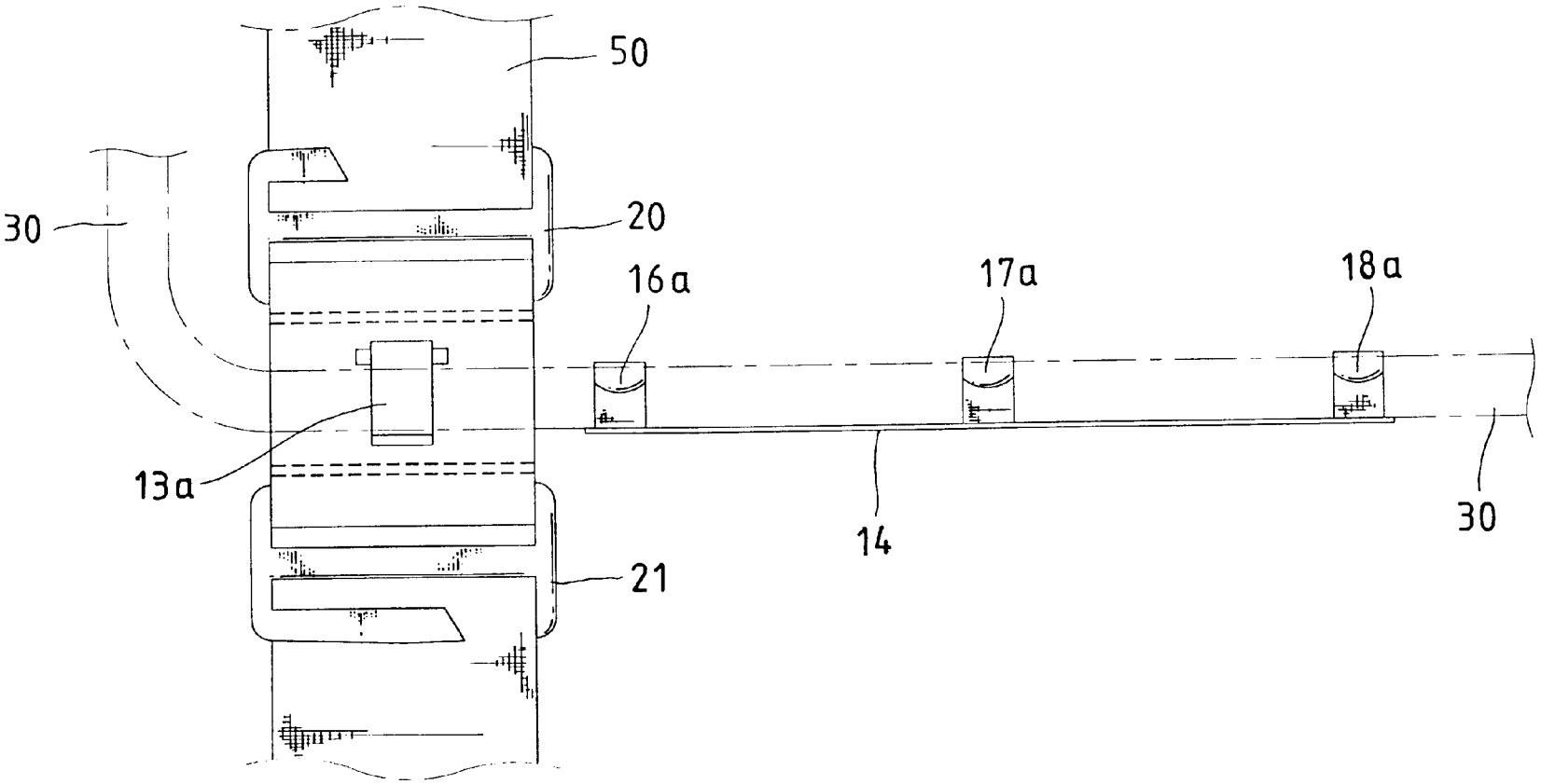
FIG. 11 is a top view of the present invention in FIG. 10.

Referring to FIGS. 10 and 11, another embodiment has the same characteristics as the present invention is shown, wherein in the structural characteristic of the present invention, the fixing seat 10*a* may penetrate through two through rings 20 and 21, meanwhile the tube holder 13*b* on the seat is made as a strip to match with a rope ring 13*c* and a buckling belt 13*d* on the strip for tightly holding and fixing the water outlet tube 30. At the same time, since the tube holders 16*a*, 17*a*, and 18*a* on the extending rod 14 is made as a strip and then a buckling belt is further sewed thereon, therefore, the same fixing effect as the tube holder is derived.

In summary, in the present invention, a simple single seat is combined with a ring body, so that the extending rod aside the fixing seat includes a flexible metal line therewithin, and a secondary effect of positioning angle is achieved. It has the advantage that in usage the water bag does not need to be cut and destroyed and the drawback of difficultly cleaning the tube may be avoided.

Although certain preferred embodiments of the present invention has been shown and described in detail, it should be understood that various changes and modifications may be made therein without departing from the scope of the appended claims.

What is claimed is:

1. An auxiliary positioning device for use with a water bag having a water outlet tube with a drinking end wherein the water bag is securable to a user, the device comprising:

a fixing seat, first and second hooks respectively coupled to opposing ends of said seat, a tube holder installed on said seat, a flexible extending rod secured to said seat, said extending rod having a bendable metal line secured therewith, said extending rod further including a plurality of spaced, additional tube holders secured thereto; and two through rings, each of said rings having two holes therein wherein one of said holes of each said ring including an inclined guiding slot extending through a peripheral portion of said one hole wherein said guiding slot allows penetration by a strap in said one hole;

wherein, in use, said one hole of each said ring is adapted to be coupled to a strap worn by a user by passing the strap through said guiding slot and in said one hole of each said ring, said first and second hooks are respectively secured to the other of said holes of said through rings, the water outlet tube is penetrated through said tube holder on said seat and is further penetrated through each of said additional tube holders secured to said extending rod, and said extending rod with said metal line secured therewith is bent to position the drinking end of the water outlet tube relative to the user.

2. An auxiliary positioning device according to claim 1 wherein said extending rod is made of soft plastic.

3. An auxiliary positioning device according to claim 1 wherein said strap is a shoulder strap.

4. An auxiliary positioning device according to claim 1 wherein said metal line is located within said extending rod.

* * * * *